US005526829A

United States Patent [19]

Smith

[11] Patent Number: 5,526,829

[45] Date of Patent: Jun. 18, 1996

[54] HAIR CURLING SYSTEM

[76] Inventor: Margaret A. Smith, 4415 Belclaire, Dallas, Tex. 75205

[21] Appl. No.: 279,067

[22] Filed: Jul. 22, 1994

Related U.S. Application Data

[63] Continuation of Ser. No. 33,544, Mar. 18, 1993, abandoned.

[51] Int. Cl.[6] ..... A45D 1/04

[52] U.S. Cl. ..... 132/229; 132/233

[58] Field of Search ..... 132/117, 118, 132/223, 227, 229, 231, 232, 233, 266, 269, 271; 219/222, 225

[56] References Cited

U.S. PATENT DOCUMENTS

| | | | |
|---|---|---|---|
| 3,291,141 | 12/1966 | Quinio et al. | 132/229 |
| 3,483,876 | 12/1969 | Planel | 132/229 |
| 3,487,197 | 12/1969 | D'Elia et al. | 132/229 |
| 3,859,497 | 1/1975 | McNair | 132/232 |
| 3,892,943 | 7/1975 | Van Drougenbroek | 132/232 |
| 3,913,592 | 10/1975 | Morane et al. | 219/222 |
| 3,918,465 | 11/1975 | Barradas | 132/232 |
| 4,101,756 | 7/1978 | Yamano | 219/222 |
| 4,260,871 | 4/1981 | Nagelkerke | 132/229 |
| 4,267,430 | 5/1981 | Downey | 132/232 |
| 4,354,092 | 10/1982 | Manabe et al. | 132/232 |
| 4,354,482 | 10/1982 | Beisccker | 132/232 |
| 4,857,702 | 8/1989 | LaFaro | 132/232 |
| 5,124,532 | 6/1992 | Hafey et al. | 132/229 |

FOREIGN PATENT DOCUMENTS

| | | | |
|---|---|---|---|
| 3824421 | 1/1990 | Germany | 132/233 |

*Primary Examiner*—John G. Weiss
*Attorney, Agent, or Firm*—Michael A. O'Neil

[57] ABSTRACT

A hair curling system wherein hair rollers are inserted over the wand of a curling iron, allowing the heating element of the curling iron to heat both the exterior surface of the curling iron and the hair rollers. Hollow cylindrical cover wands having graduated exterior diameters are inserted over the wand of the curling iron, allowing the heating element of the curling iron to heat the underlying curling wand and the cover wand simultaneously, so that larger looser curls may be formed with the larger diameter cover wand and smaller tighter curls formed with the smaller diameter underlying wand upon removal of the cover wand. The heating element of the hair curling system may be actuated by AC or DC current or be equipped for actuation by combustible gas contained within a disposal canister.

14 Claims, 3 Drawing Sheets

10
12
14
16
18
20
22
24
26
28
30
32
34
36
38
40
42
44
46
48
50
52
60
62
64
66
68
70
72
74
76
78
80

HAIR CURLING SYSTEM

This application is a continuation of application Ser. No. 08/033,544, filed Mar. 18, 1993, now abandoned.

TECHNICAL FIELD

This invention relates to hot rollers and curling irons for styling hair, and more particularly to a portable system for heating both a curling iron and hot rollers with a common heating element.

BACKGROUND OF THE INVENTION

Since the beginning of time men and women have sought to achieve flattering, fashionable hair styles. Everything from chemical treatments for long term alteration of the hair, "permanents" to short term rolling of the hair have been employed. Where temporary changes were sought, hair rollers were traditionally placed in wet hair. The hair was allowed to dry, setting the curl formed in the hair by wrapping the wet hair around the rollers. Unfortunately several hours were required for the hair to dry.

For quick fixes, hot rollers and curling irons evolved to temporarily wave and curl the hair to achieve desired hair styles quickly and easily. Early curling irons and crimping irons were placed in hot coals or a flame to sufficiently heat the metal before wrapping the hair around the heated rod or placing the hair between offset tines of the crimping iron. During the 60's and 70's, the early curling and crimping irons and wet hair rollers evolved into quick and easy to use electric hot rollers and curling irons of all shapes, sizes and configurations.

Modern day curling irons typically consist of a single long slender wand heated through the use of a heating element actuated by some type of power source, such as AC electrical current, batteries, or various types of disposable canisters of combustible gas, such as butane. The wand portion of the curling iron may be any one of many different diameters, may have bristles extending outwardly from the wand similar to a hair brush, or may have interchangeable wand shapes and sizes. Regardless of the number of interchangeable wands, the curling iron is capable of only heating one small section of hair at a time. Therefore, if the entire head of hair is to be curled, the time required to accomplish the task with a curling iron may be considerable.

Most present day hot rollers are contained within a case having a plurality of metal heating elements extending upwardly from a base with the heating elements actuated by some type of power source. The heating elements are heated at the same time allowing multiple rollers to be heated at once. The rollers may then be placed in the hair, and remain therein until the rollers have cooled, setting the crimp or curl in the hair. Because the rollers cool down once they are placed in the hair, they cannot be used to touch-up stray strands which may slip from the roller or to lightly curl portions of the hair where a tight curl is not desired, such as bangs or small tendrils of hair which are more suited to curling with a curling iron. Thus, hot rollers and curling irons are frequently used in combination, requiring that two separate pieces of equipment be heated and used to achieve a desired hair style.

Such situation becomes increasingly burdensome when traveling. The case containing the hot rollers takes up a considerable amount of room in the luggage. One or two curling irons may be required in addition to the rollers, thereby increasing the luggage weight and space required when travelling.

SUMMARY OF THE INVENTION

The present invention overcomes the foregoing and other disadvantages associated with the use of curling irons and hot rollers by combining the rollers and curling iron for simultaneous heating through the use of one heating element, thereby reducing the space required for packing the hair styling products. The curling iron of the present invention is connected to a power source and is retained in an upright position in a base unit.

When placed in the base unit, the curling iron extends upwardly from the base unit allowing several hollow rollers having heat absorbing interior linings to be placed over the wand of the curling iron. A single heating element within the wand of the curling iron heats both the curling iron and the rollers through the contact of the heat absorbing interior lining of the rollers with the surface of the curling wand. As the rollers are removed from the curling iron and placed in the hair, additional rollers may be placed on the wand for heating.

In a hair curling system incorporating another embodiment of the invention, a larger, hollow, cover wand having an interior heat absorbing lining and an interior diameter slightly larger than the exterior diameter of the wand portion of the curling iron is placed over the curling iron and heated by contact of the heat absorbing interior lining with the surface of the wand portion of the curling iron, thereby effectively increasing the diameter of the curling iron to allow for larger and looser curls. Larger diameter rollers are placed over the cover wand, whereby the heating element effectively heats the larger diameter rollers, the cover wand, and the wand of the curling iron. Thus, the large diameter rollers may be removed from the curling iron, placed in the hair, the larger diameter wand used to form looser curls, then removed and the smaller diameter curling iron used for small detailed curling.

In the preferred embodiment of the invention the power source is AC and/or DC current adapted for use with both 120 or 220 voltage outlets and both United States and European frequencies. In the event AC current is used, the base unit includes a socket for matingly receiving a plug from the curling wand to deliver electric current to the heating element from an exterior power source. The electrical base unit includes an adapter to allow the base unit to be plugged into a cigarette lighter for quick touch-ups in the car, on the boat, or wherever a cigarette lighter may be found.

Likewise, in a hair curling system incorporating yet another embodiment of the invention, the curling iron is adapted for attachment to a gas cylinder for actuating the heating element. A base unit for receiving the gas cylinder allows the curling iron to be retained in an upright position for receiving the rollers thereon.

The hair curling system of the present invention, therefore, allows for more compact, easy traveling, easy setup and use of hot rollers and a curling iron.

BRIEF DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION

Figures 1, 2:
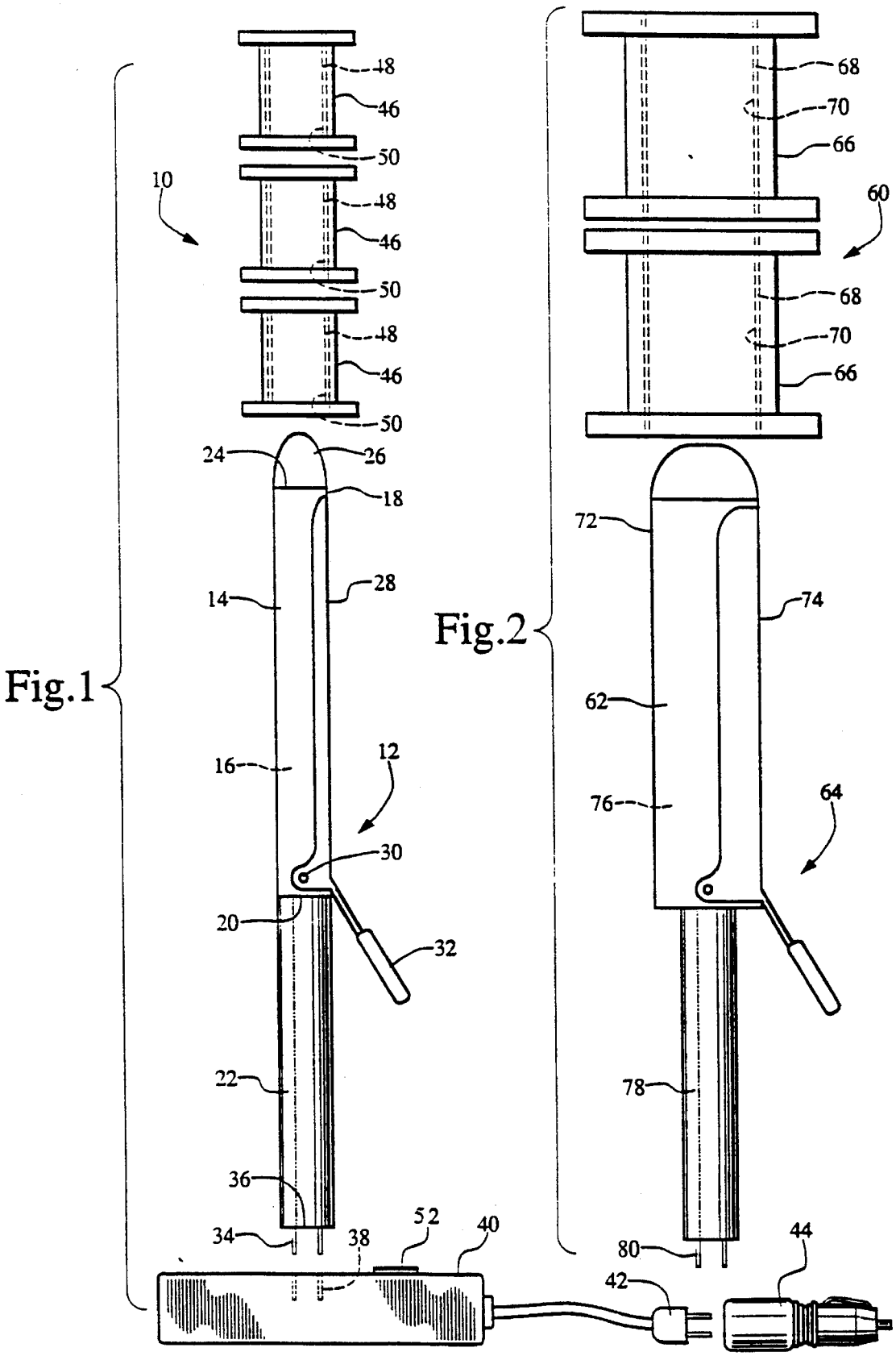
FIG. 1 is a side view of a hair curling system incorporating a first embodiment of the present invention, including a cigarette lighter adapter.
FIG. 2 is a view similar to FIG. 1 showing a hair curling system incorporating a second embodiment of the present invention.
Figure 3:
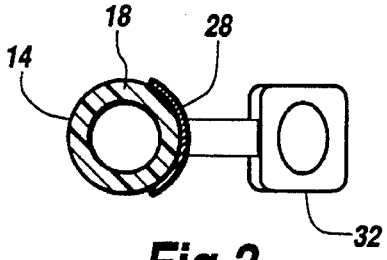
FIG. 3 is a top sectional view of the curling iron of FIG. 1 showing the location of the hair clamp of the curling iron.

Referring now to FIGS. 1 and 3, there is shown a hair curling system 10 including a curling iron 12 having a hollow cylindrical curling wand 14 housing a heating element 16 for heating the exterior surface 18 of the wand 14. Attached to a first end 20 of the wand 14 is a handle 22 housing the necessary wiring for delivering power to the heating element 16 for heating the exterior surface 18 of the wand 14. Attached to a second end 24 of the wand 14 is a curved cap 26 for facilitating the positioning of the wand 14 between strands of hair.

A hair retaining clamp 28 curves around a portion of the wand 14 for retaining the hair in position after it is wound around the wand 14. The clamp 28 is pivotally attached to the wand 14 at points 30 on opposed sides of the wand 14. Thus, by applying pressure to a trigger 32 extending diagonally outwardly from the hair retaining clamp 28 near the pivotal attachment points 30, the hair retaining clamp 28 is moved away from the exterior surface 18 of the wand 14 to allow positioning or removal of the hair around the wand 14.

A plug 34 seals the distal end 36 of the handle 22 and is matingly received in a socket 38 in a base unit 40. The base unit 40 is equipped with a plug 42 for receiving power from an exterior source for delivery to the heating element 16. An adapter 44 matingly receives the plug 42, thereby allowing power to be delivered to the heating element from a cigarette lighter. The curling iron 12 and base unit 40 are adapted for use with both 120 and 220 volt outlets with either United States or European frequencies.

Hollow hair rollers 46 having an interior diameter slightly larger than the exterior diameter of the wand 14 and hair retaining clamp 28 are slid downwardly over the wand 14. A heat absorbing lining 48 forming the interior surface 50 of the rollers 46 contacts the exterior surface 18 and the hair retaining clamp 28 of the curling iron 12, thereby causing the heating element 16 to heat the rollers 46 at the same time as it heats the curling wand 14. As the curlers 46 are heated, they are removed from the curling iron 12 and placed in the hair to set the curl therein. Once the rollers are removed from the curling iron, additional rollers may be positioned surrounding the wand 14 or the wand may be removed from the base 40 and used as a traditional curling iron for curling portions of hair not wound around the rollers 46. The base unit 40 may be equipped with an on/off switch 52 for controlling the delivery of power to the heating element 16.

Referring now to FIG. 2, there is shown a hair curling system 60 incorporating a second embodiment of the present invention. The wand 62 of the curling iron 64 has a larger exterior diameter than the wand 14 of the curling iron 12 of FIG. 1, thereby allowing for a larger looser curl. Likewise, the hair rollers 66 have a larger exterior diameter than the hair rollers 46 of FIG. 1, allowing for larger, looser curls. As with the curling system 10 of FIG. 1, when the rollers 66 are placed over the wand 62 a heat absorbing lining 68 forming the interior surface 70 of the rollers 66 contacts the exterior surface 72 of the wand 62 and the hair retaining clamp 74, thereby allowing the heating element 76 to heat both the wand 62 and the rollers 66. The handle 78 may be of the same size as the handle 22 of FIG. 1 or any other size, so long as the plug 80 may be matingly received in the socket 38 of the base unit 40 of FIG. 1.

Figure 4:
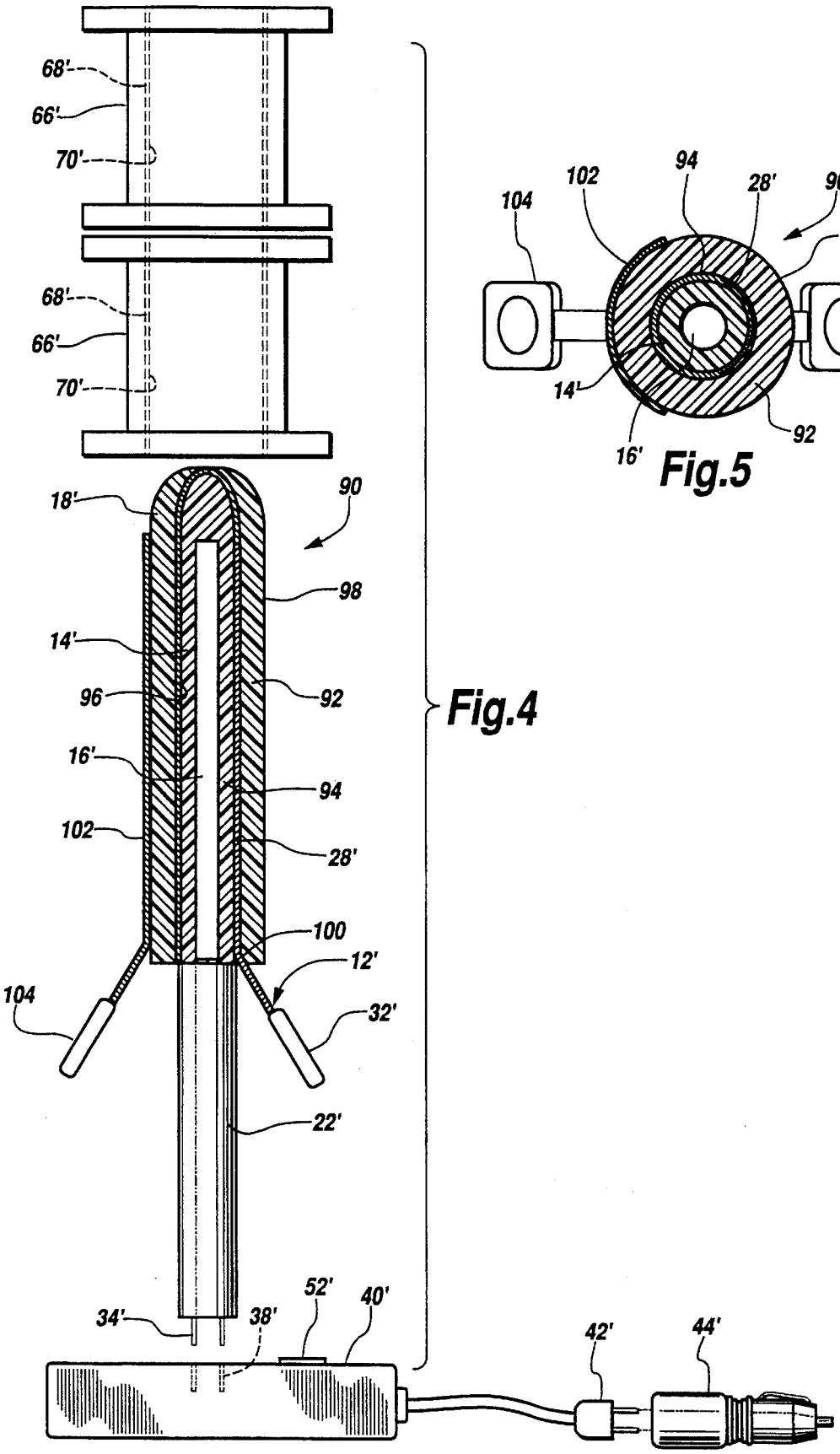
FIG. 4 is a partial sectional view of a hair curling system incorporating a third embodiment of the present invention including a cover wand.
Figure 5:
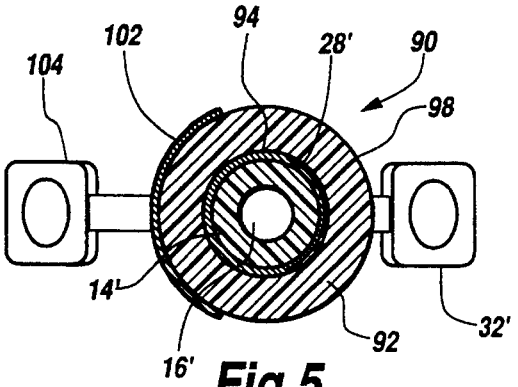
FIG. 5 is a top sectional view of the curling iron and cover wand of FIG. 4.

Referring now to FIGS. 4 and 5, there is shown a hair curling system 90 incorporating a third embodiment of the present invention. Many of the elements of the hair curling system 90 are similar to those of the hair curling system 10 of FIG. 1 and will be given the same reference numerals with the elements of the hair curling system 90 being differentiated by a prime "'" designation.

A hollow cylindrical cover wand 92 having a heat absorbing lining 94 forming the interior surface 96 of the cover wand 92 contacts the exterior surface 18' of the curling wand 14' when the cover wand 92 is placed over the curling wand 14'. The heating element 16' contained within the curling wand 14' thereby heats the curling wand 14', in turn heating the cover wand 92. The hair curling system 90 includes any number of cover wands 92 having various diameters for achieving curls of various sizes.

The interior surface 96 of the cover wand 92 is tapered outwardly toward the exterior surface 98 of the wand 92 at a location 100 to allow positioning of the trigger 32' of the hair retaining clamp 28' of the curling iron 12'. The handle 22' of the curling iron 12' functions as the handle for the cover wand 92 as well as the handle for the curling wand 14'. Thus, the cover wand 92 may be used to form larger looser curls with the hair retaining clamp 102 being pivotally positioned by the trigger 104 to retain the hair in position around the cover wand 92. The cover wand 92 may then be removed and another cover wand of a different size be placed on the wand 14' of the curling iron 12' for heating, or the smaller diameter wand 14' used to form tighter curls.

Larger diameter rollers 66' may be placed over cover wand 92, whereby the heating element 16' effectively heats curling wand 14', cover wand 92 and the large diameter rollers 66'. Thus the large diameter rollers 66' may be removed from the cover wand 92, placed in the hair, the cover wand 92 used to form looser curls, then cover wand 92 removed and smaller diameter curling wand 14' used for smaller detailed curling.

The base unit 40' includes a socket for matingly receiving plug 34' from the curling wand 14' to deliver electric current to the heating element 16' from an exterior power source 42'. The electrical base unit 40' includes an adapter 44' to allow the base unit to be plugged into a cigarette lighter for quick touch-ups in the car, on the boat or wherever a cigarette lighter may be found.

Figure 6:
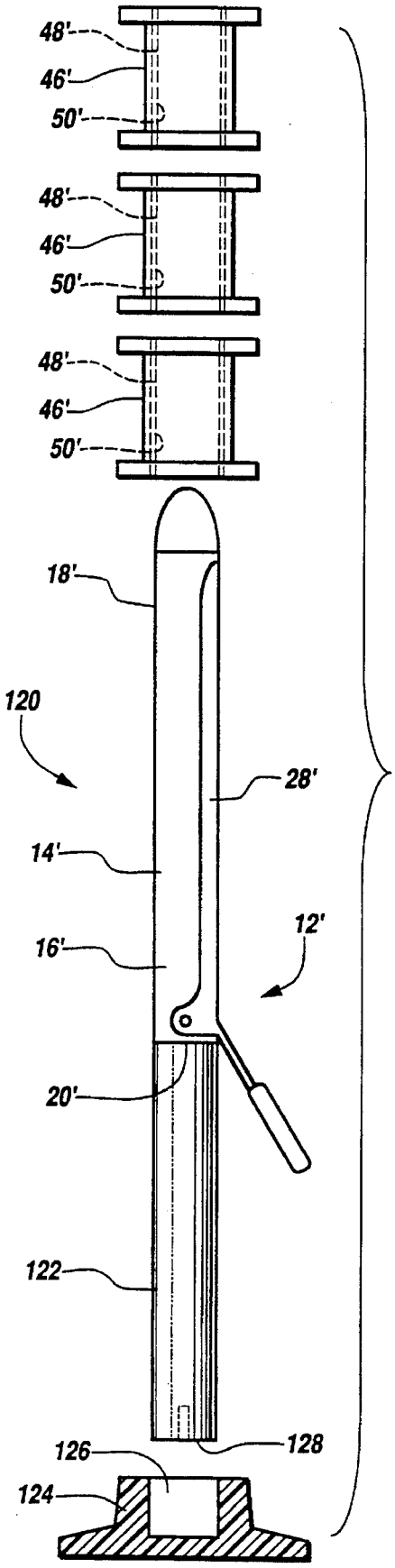
FIG. 6 is a view similar to FIG. 1 showing a hair curling system incorporating a fourth embodiment of the present invention having a gas canister and stabilizing base.
Figure 7:
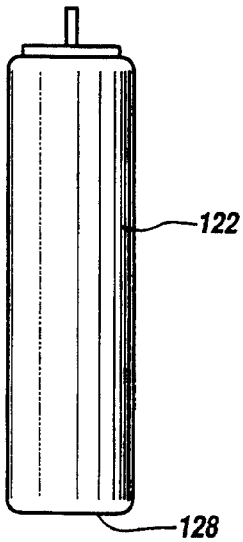
FIG. 7 is a front view of the gas canister of the hair curling system of FIG. 6.

Referring now to FIGS. 6 and 7, there is shown a hair curling system 120 incorporating a fourth embodiment of the present invention. Many of the elements of the hair curling system 120 are similar to those of the hair curling system 10 of FIG. 1 and will be given the same reference numerals with the elements of the hair curling system 120 being differentiated by a prime "'" designation. The hair curling system 120 is equipped to receive a disposable canister 122 of a combustible gas, such as butane, in the first end 20' of the wand 14' for actuating the heating element 16' to heat the curling iron 12' and the hair rollers 46' when they are placed over the wand 14' such that the heat absorbing lining 48' forming the interior surface 50' of the rollers 46' contacts the exterior surface 18' of the wand 14' and the hair retaining clamp 28'. A base unit 124 contains an upwardly opened chamber 126 for receiving the distal end 128 of the canister 122 therein for retaining the curling iron 12' in an upright position for receiving the rollers 46' on the curling wand 14'. The combustible gas canister 122 allows use of the curling iron and rollers in situations wherein batteries and/or AC currents are unavailable or inconvenient.

Each of the embodiments of the hair curling system of the present invention reduces the number of hair styling items which must be packed for travel, reduces the number of items which must be plugged in, and facilitates quick, easy styling in any location. The costs of the hair styling system are reduced due to the fewer numbers of materials needed for manufacturing a small number of items, excluding such things as bulky carrying cases and heating elements for electric rollers.

Although preferred embodiments of the invention have been illustrated in the accompanying Drawings and described in the foregoing Detailed Description, it will be understood that the invention is not limited to the embodiments disclosed, but is capable of numerous rearrangements and modifications of parts and elements without departing from the spirit of the invention.

I claim:

1. A hair curling system comprising:

a cylindrical curling wand around which the hair is curled, said curling wand having an exterior diameter;

a heating element within the curling wand for heating the wand;

at least one hollow cylindrical cover wand having a closed first end, an open first end, an open second end and an interior diameter slightly larger than the exterior diameter of the curling wand for placement of the cover wand over the curling wand for heating the cover wand for larger diameter curls; and a plurality of hollow cylindrical hair rollers each having an interior diameter slightly larger than the exterior diameter of the curling wand and having an unobstructed first end and an unobstructed second end such that the curling wand can be inserted completely therethrough to allow the plurality of the hair rollers to be inserted onto and, simultaneously heated by, the curling wand.

2. The hair curling system of claim 1, further comprising a plurality of cylindrical hair rollers each having a channel extending longitudinally therethrough and having an interior diameter slightly larger than the exterior diameter of the cover wand for insertion of the cover wand through the channel for heating the rollers while heating the cover wand.

3. A portable hair curling system comprising:

a cylindrical curling wand around which the hair is curled, said curling wand having a closed first end, an open second end and an exterior diameter;

a heating element within the curling wand for heating the wand to set the curl in hair wound around the wand;

a hollow handle attached to and extending outwardly from the second end of the wand for providing a cool surface for holding the wand;

plug means extending from the handle for delivering power to the heating element; and a plurality of cylindrical hair rollers each having a channel extending longitudinally therethrough, an interior diameter slightly larger than the exterior diameter of the curling wand and having an unobstructed first end and an unobstructed second end such that the curling wand can be inserted completely therethrough to allow the plurality of the hair rollers to be inserted onto, and simultaneously heated by the curling wand.

4. The hair curling system of claim 3, further comprising a base having a receptacle for matingly receiving and retaining the curling wand in an upright position therein.

5. The hair curling system of claim 4, wherein the base further comprises:

means for receiving electrical power from an external source; and an electrical receptacle for receiving the plug means therein and for delivering power to the heating element from the external source.

6. The hair curling system of claim 5, further comprising adapter means for receiving power from a cigarette lighter.

7. The hair curling system of claim 3, further comprising at least one hollow cylindrical cover wand having a closed first end, an open second end, and an interior diameter slightly larger than the exterior diameter of the curling wand for placement of the cover wand over the curling wand for heating the cover wand for larger diameter curls.

8. The hair curling system of claim 7, further comprising a plurality of cylindrical hair rollers each having a channel extending longitudinally therethrough and having an interior diameter slightly larger than the exterior diameter of the cover wand for insertion of the cover wand through the channel for heating the rollers while heating the cover wand.

9. A portable hair curling system comprising:

a cylindrical curling wand around which the hair is curled, said curling wand having a closed first end, an open second end;

a heating element within the curling wand for heating the wand to set the curl in hair wound around the wand;

a hollow handle attached to and extending outwardly from the second end of the wand for providing a cool surface for holding the wand;

plug means extending from the handle for delivering electrical power to the heating element;

a plurality of cylindrical hair rollers each having a channel extending longitudinally therethrough and having an interior diameter slightly larger than the exterior diameter of the curling wand and having an unobstructed first end and an unobstructed second end such that the curling wand can be inserted completely therethrough to allow the plurality of the hair rollers to be inserted onto, and simultaneously heated by, the curling wand;

power base means having an electrical receptacle for receiving the plug means therein and retaining the curling wand in an upright position; and means for delivering electrical power from an external power source to the power base means.

10. The hair curling system of claim 9, further comprising adapter means for receiving power from a cigarette lighter.

11. The hair curling system of claim 9, further comprising at least one hollow cylindrical cover wand having a closed first end, an open second end, and an interior diameter slightly larger than the exterior diameter of the curling wand for placement of the cover wand over the curling wand for heating the cover wand for larger diameter curls.

12. The hair curling system of claim 11, further comprising a plurality of cylindrical hair rollers each having a channel extending longitudinally therethrough and having an interior diameter slightly larger than the exterior diameter of the cover wand for insertion of the cover wand through the channel for heating the rollers while heating the cover wand.

13. A hair curling system comprising:

a hollow cylindrical curling wand around which the hair is curled;

a heating element within the curling wand for heating the wand;

a plurality of hollow cylindrical hair rollers having an interior diameter slightly larger than the exterior diameter of the curling wand for insertion of the curling wand through the rollers for heating the rollers while heating the curling wand; and at least one hollow cylindrical cover wand having a closed first end, an open second end, and an interior diameter slightly larger than the exterior diameter of the curling wand for placement of the cover wand over the curling wand for heating the cover wand for larger diameter curls.

14. The hair curling system of claim 13, further comprising a plurality of cylindrical hair rollers each having a channel extending longitudinally therethrough and having an interior diameter slightly larger than the exterior diameter of the cover wand for insertion of the cover wand through the channel for heating the rollers while heating the cover wand.

* * * * *